US005253626A

United States Patent [19]

Hatano et al.

[11] Patent Number: 5,253,626

[45] Date of Patent: Oct. 19, 1993

[54] ROTATIONAL SPEED CONTROL SYSTEM FOR INTERNAL COMBUSTION ENGINE

[75] Inventors: Yasukazu Hatano; Hidetoshi Suzuki, both of Numazu; Satoshi Hitomi, Shizuoka, all of Japan

[73] Assignee: Kokusan Denki Co., Ltd., Japan

[21] Appl. No.: 958,558

[22] Filed: Oct. 6, 1992

[51] Int. Cl.[5] ..... F02D 41/14

[52] U.S. Cl. ..... 123/352; 123/339; 123/357

[58] Field of Search ..... 123/352-355, 123/339, 357; 180/176, 179

[56] References Cited

U.S. PATENT DOCUMENTS

| | | | |
|---|---|---|---|
| 3,724,433 | 4/1973 | Voss et al. | 123/353 |
| 4,138,975 | 2/1979 | Hamelin et al. | 123/339 |
| 4,242,994 | 1/1981 | Keely | 123/339 |
| 4,286,685 | 9/1981 | Rudolph et al. | 123/353 X |
| 4,289,100 | 9/1981 | Kinugawa et al. | 123/339 |
| 4,306,527 | 12/1981 | Kinugawa et al. | 123/339 |
| 4,669,436 | 6/1987 | Nanjyo et al. | 123/357 |

FOREIGN PATENT DOCUMENTS 0015623 4/1980 Japan .

*Primary Examiner*—Tony M. Argenbright

*Attorney, Agent, or Firm*—Pearne, Gordon, McCoy & Granger

[57] ABSTRACT

A rotational speed control system for an internal combustion engine capable of preventing a dead time or dead section from occurring in controlling of a rotational speed of the engine. An integrating circuit is controlled by means of an output of a comparator for comparing a rotational speed detection signal with a target rotational speed setting signal, to thereby obtain an integral voltage which falls and rises when the rotational speed detection signal is above and below the target rotational speed setting signal, respectively. Comparison of the integral voltage with a sawtooth signal voltage leads to a pulse signal subjected to pulse width modulation. The pulse signal is fed to an actuator driving circuit to carry out on-off controlling of a drive current for the actuator. Connection of voltage limiting circuits to the integrating circuit causes a variation of the integral voltage to be limited within a range of amplitude of the integral voltage, to thereby eliminate the dead time or dead section.

6 Claims, 3 Drawing Sheets

ROTATIONAL SPEED CONTROL SYSTEM FOR INTERNAL COMBUSTION ENGINE

BACKGROUND OF THE INVENTION

This invention relates to a rotational speed control system for an internal combustion engine, and more particularly to a rotational speed control system for controlling a rotational speed of an internal combustion engine in a manner to coincide it with a target rotational speed.

Conventionally, a rotational speed control system which is adapted to coincide a rotational speed of an internal combustion engine with a target rotational speed has been proposed in the art. One type of such a rotational speed control system is disclosed in U.S. Pat. No. 3,724,433, which is constructed so as to differentiate a rotational speed detection signal to obtain a first differential signal and then detect a phase between the first differential signal and a second differential signal obtained by differentiating a target rotational speed signal generated from an oscillator, to thereby coincide the rotational speed with the target rotational speed.

Another type of the conventional rotational speed control system is disclosed in U.S. Pat. No. 4,669,436, which is adapted to prepare a speed deviation signal using a rotational speed detection signal, an accelerator position signal and a droop factor signal and then subject the speed deviation signal to integration to obtain a signal, which is then used for controlling a rac actuator.

Further, Japanese Patent Publication No. 15623/1980 (55-15623) discloses a further type of such a conventional rotational speed control system constructed so as to obtain a pulse signal of which a pulse width is modulated depending on a difference between an actual rotational speed of an internal combustion engine and its target rotational speed. The pulse signal thus obtained is then used for on-off controlling of a drive current fed to an actuator adapted to adjust a rate of fuel fed to the engine. In the rotational speed control system disclosed in the Japanese publication, an integral signal obtained by integrating a difference between a rotational speed detection signal and a temperature detection signal is compared with a sawtooth signal voltage in a comparator, resulting in the pulse signal for driving the actuator being obtained. Unfortunately, the control system disclosed fails to permit an output of the comparator to be varied during a length of time for which the integral voltage is kept between a maximum value of the sawtooth signal voltage and a power supply voltage and between a minimum value of the sawtooth signal voltage and 0 V, so that a dead time or dead section occurs in controlling of the rotational speed. This causes response to the controlling to be delayed, resulting in overshoot being increased.

SUMMARY OF THE INVENTION

The present invention has been made in view of the foregoing disadvantage of the prior art.

Accordingly, it is an object of the present invention to provide a rotational speed control system for an internal combustion engine which is capable of preventing a dead time or dead section from occurring in controlling of a rotational speed of an internal combustion engine to improve control characteristics of the system.

It is another object of the present invention to provide a rotational speed control system for an internal combustion engine which is capable of accomplishing the above-described object with a simplified construction.

In accordance with the present invention, a rotational speed control system for an internal combustion engine is provided. The rotational speed control system generally includes a fuel feed rate adjusting means for adjusting a rate of fuel fed to the internal combustion engine, an actuator for actuating the fuel feed rate adjusting means, a rotational speed detecting circuit for detecting a rotational speed of the engine to generate a rotation speed detection signal, a target rotational speed setting circuit for generating a target speed setting signal representing a target rotation speed, a comparator, an oscillating circuit, an oscillator, a pulse width modulation circuit, an actuator driving circuit, and a voltage limiting circuit.

The comparator carries out comparison between the speed dection signal and the target speed setting signal, to thereby generate an integration command signal while the speed detection signal exceeds the target speed setting signal. The integrating circuit includes an integrating capacitor and permits the integrating capacitor to be charged at a predetermined time constant while the comparator generates the integration command signal. The oscillator generates a sawtooth signal voltage varied between a minimum level above an earth level and a maximum level lower than a power supply voltage. The pulse width modulation circuit carries out comparison between an integral voltage obtained across the integrating capacitor and the sawtooth signal voltage, to thereby generate a pulse signal kept at a high level for a period of time during which the integral voltage exceeds the sawtooth signal voltage. The actuator driving circuit is fed with the pulse signal generated from the pulse width modulation circuit, to thereby permit a drive current to flow through the actuator for a period of time during which the pulse signal is kept at a high level. The voltage limiting circuit limits a maximum level of the integral voltage to the maximum level of the sawtooth signal voltage or below and a minimum level of the integral voltage voltage to a minimum level of the sawtooth signal voltage or above.

In a preferred embodiment of the present invention, the voltage limiting circuit comprises a first voltage clamping circuit for limiting the maximum level of the integral voltage to the maximum level of the sawtooth signal voltage or below and a second voltage clamping circuit for limiting the minimum level of the integral voltage to the minimum level of the sawtooth signal voltage or above.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a rotational speed control system for an internal combustion engine according to the present invention will be described hereinafter with reference to the accompanying drawings.

Figure 1:
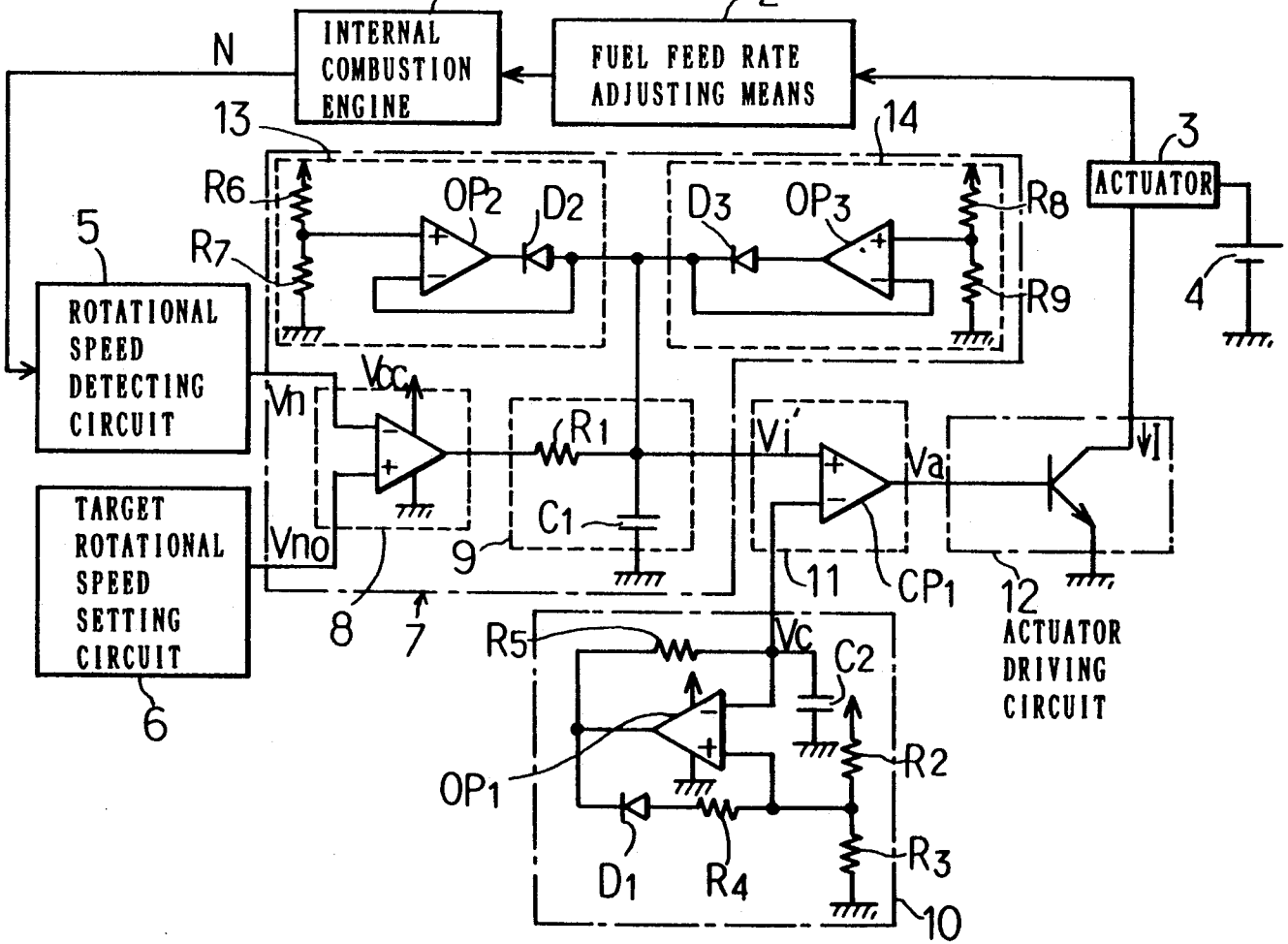
FIG. 1 is a circuit diagram showing an embodiment of a rotational speed control system for an internal combustion engine according to the present invention.

Referring first to FIG. 1 showing an embodiment of a rotational speed control system for an internal combustion engine according to the present invention, a rotation speed control system of the illustrated embodiment includes a fuel feed rate adjusting means 2 adapted to control or adjust a fuel feed rate or a rate of fuel fed to an internal combustion engine 1. The fuel feed rate adjusting means 2 may comprise any suitable means such as a throttle valve, an injection adjusting rack for a fuel injection pump or the like. The control system also includes an actuator 3 for actuating or operating the fuel feed rate adjusting means 2 depending on a drive current fed thereto. The actuator 3 is adapted to be driven through a DC power supply 4 such as a battery or the like.

The control system of the illustrated embodiment further includes a rotation speed detecting circuit 5 for generating a rotational speed detection signal Vn proportional to an actual rotational speed N (rpm) of the internal combustion engine 1. The rotational speed detection circuit 5 may comprise a frequency-voltage converter (hereinafter referred to as "F/V converter") adapted to use, as an input thereof, a signal of a frequency proportional to a rotational speed of the engine 1 to convert the frequency of the signal into a voltage signal.

Reference numeral 6 designates a target rotational speed setting circuit, which generates a target rotational speed setting signal Vno representing a target rotational speed of the engine.

In addition, the control system of the illustrated embodiment includes an operational circuit generally designated by reference numeral 7, which comprises a comparator 8 and an integrating circuit 9. The comparator 8 carries out comparison between the rotational speed detection signal Vn and the target rotational speed setting signal Vno, so that an output stage thereof is rendered "on" when the rotational speed detection signal Vn exceeds the target rotational speed setting signal Vno, resulting in the comparator generating an output of a low level (earth or ground level). Also, the comparator 8 generates an output of a high level when the rotational speed detection signal Vn does not exceed the target rotational speed setting signal Vno, because the output state is rendered "off". The integrating circuit 9 comprises a resistor R1 and an integrating capacitor C1 and permits the integrating capacitor C1 to be charged at a predetermined time constant through the resistor R1 for a period of time during which the output of the comparator 8 is kept at a high level. This causes an integral voltage Vi to be obtained across the integrating capacitor C1, which voltage Vi rises at a predetermined inclination when the rotational speed detection signal Vn does not exceed the target rotational speed setting signal Vno and falls at a predetermined inclination when the former exceeds the latter.

Reference numeral 10 designates an oscillator which includes a capacitor C2, resistors R2 to R5 and a diode D1 and generates a sawtooth signal voltage Vc. The oscillator may comprise an astable multivibrator known in the art.

The control system of the illustrated embodiment also includes a pulse width modulation circuit 11 comprising a comparator CP1. The comparator CP1 is fed at a non-inverting input terminal thereof with the integral voltage V1 obtained across the integrating capacitor C1 and at an inverting input terminal thereof with the sawtooth signal voltage Vc. The comparator CP1 generates a pulse signal Va kept at a high level for a period of time during which the integral voltage Vi exceeds the sawtooth signal voltage Vc, which pulse signal Va is then fed to an actuator driving circuit 12.

The actuator driving circuit 12 includes a switching device operated by the pulse signal Va, such as a transistor or the like and feeds the actuator 3 with a driving current while the pulse signal Va is kept at a high level.

Reference numerals 13 and 14 designate a first voltage clamping circuit and a second voltage clamping circuit, respectively, which constitute a voltage limiting circuit for limiting a maximum level of an integral voltage Vi' to a maximum level Vch of the sawtooth signal voltage Vc or below and a minimum level of the integral voltage Vi' to a minimum level Vcl of the sawtooth signal voltage Vc or above. The integral voltage Vi' indicates the integral voltage Vi limited by the first and second voltage clamping circuits 13 and 14. The first voltage clamping circuit 13 includes an operational amplifier OP2, a diode D2, and resistors R6 and R7 and has an output terminal constituted by an anode of the diode D2 and connected to a non-earth side terminal of the integrating capacitor C1. In the voltage clamping circuit 13 thus constructed, when a voltage across the integrating capacitor C1 does not exceed a voltage across the resistor R7, an output state of the operational amplifier OP2 is rendered "off", resulting in a current not flowing through the diode D2. Thus, the voltage clamping circuit 13 does not affect the integral voltage Vi'. When the voltage across the integrating capacitor C1 exceeds the voltage across the resistor R7, the output state of the operational amplifier OP2 is rendered "on", to thereby cause a charging current of the capacitor C1 to flow through the diode D2 into the output stage of the operational amplifier OP2, resulting in an increase in voltage across the capacitor C1 being prevented. Thus, the integral voltage Vi' is limited to a level of the voltage across the resistor R7 [clamping voltage$=\{R7/(R6+R7)\}Vcc$] or below.

The second voltage clamping circuit 14 includes an operational amplifier OP3, a diode D3, and resistors R8 and R9 and has an output terminal constituted by a cathode of the diode D3 and connected to a non-earth side terminal of the integrating capacitor C1. In the second voltage clamping circuit 14 thus constructed, when the voltage across the integrating capacitor C1 exceeds a voltage across the resistor R9, an output state of the operational amplifier OP3 is rendered "on", resulting in any current not flowing through the diode D3. Thus, the voltage clamping circuit 14 does not affect the integral voltage Vi'. When the voltage across the integrating capacitor C1 does not exceed the voltage across the resistor R9, the output state of the operational amplifier OP3 is rendered "off", to thereby cause a charging current to flow from the power supply through the diode D3 into the integrating capacitor C1, resulting in a decrease in voltage across the capacitor C1 being prevented. Thus, the integral voltage Vi' is prevented from being below the voltage across the resistor R9 [clamping voltage $=\{R9/(R8+R9)\}\times Vcc$].

The above-described clamping voltage is set as $Vch \geqq \{R7/(R6+R7)\}Vcc > \{R9/(R8+R9)\}Vcc \geqq Vcl$. Setting of $\{R7/(R6+R7)\}Vcc = Vch$ and $\{R9/(R8+R9)\}Vcc = Vcl$ permits the integral voltage to be varied within a range of $Vcl = \leqq Vi' \leqq Vch$.

Now, the manner of operation of the rotational speed control system of the illustrated embodiment constructed as described above will be described hereinafter.

Figure 3A:
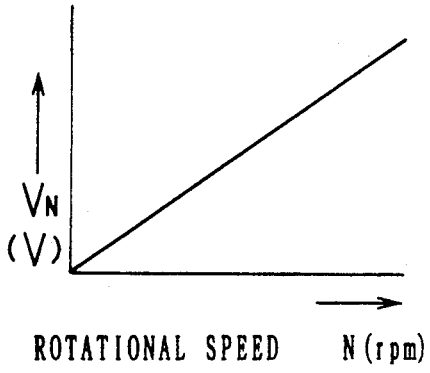
FIG. 3A is a graphical representation showing an example of characteristics of a rotational speed detecting circuit incorporated in a rotational speed control system for an internal combustion engine according to the present invention.
Figure 3B:
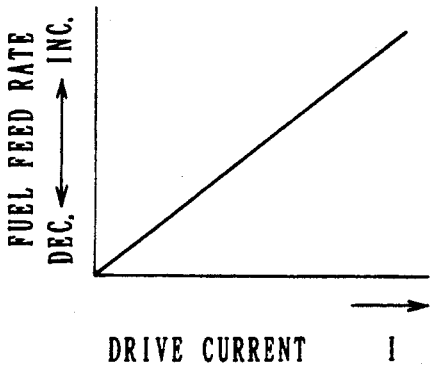
FIG. 3B is a graphical representation showing an example of a relationship between a drive current and a fuel feed rate in a rotational speed control system for an internal combustion engine according to the present invention.

First, in order to facilitate understanding of the operation, the description will be made on the case that the first and second voltage clamping circuits 13 and 14 are eliminated. The output of the comparator CP1 of the pulse width modulation circuit 11 is kept at a high level while the integral voltage Vi exceeds the sawtooth signal voltage Vc, so that the pulse signal Va of which a pulse width is modulated by the integral voltage Vi may be obtained on the output side of the comparator CP1. The actuator driving circuit 12 flows a drive current I to the actuator 3 for a period of time Ton during which the pulse signal Va is kept at a high level. The actuator 3 operates the fuel feed rate adjusting means 2 toward a fuel increase side, to thereby increase the fuel feed rate. As shown in FIG. 3B, the fuel feed rate is varied depending on the drive current I (average value) of the actuator 3.

When the rotational speed of the engine is below the target rotational speed ($Vn < Vno$), the integral voltage Vi obtained from the integrating circuit 9 is increased, so that a pulse width of the pulse obtained from the comparator CP1 is increased. This permits the drive current I fed to the actuator 3 to be increased, so that the fuel feed rate may be increased. This results in the rotational speed of the engine approaching the target rotational speed.

The rotational speed of the engine is varied or not stationary, so that the output state of the comparator 8 repeats "on" and "off" when the rotational speed approaches the target rotational speed, thus, the output of the comparator 8 is varied between a low level and a high level, during which the integral voltage Vi obtained across the integrating capacitor C1 is kept substantially constant.

When the rotational speed of the engine is above the target rotational speed, the integral voltage Vi obtained from the integrating circuit 9 is decreased, therefore, the pulse width of the pulse obtained from the comparator CP1 is reduced. This causes the fuel feed rate to be decreased, resulting in the rotational speed being returned toward the target rotational speed.

Figures 2A, 2B, 2C:
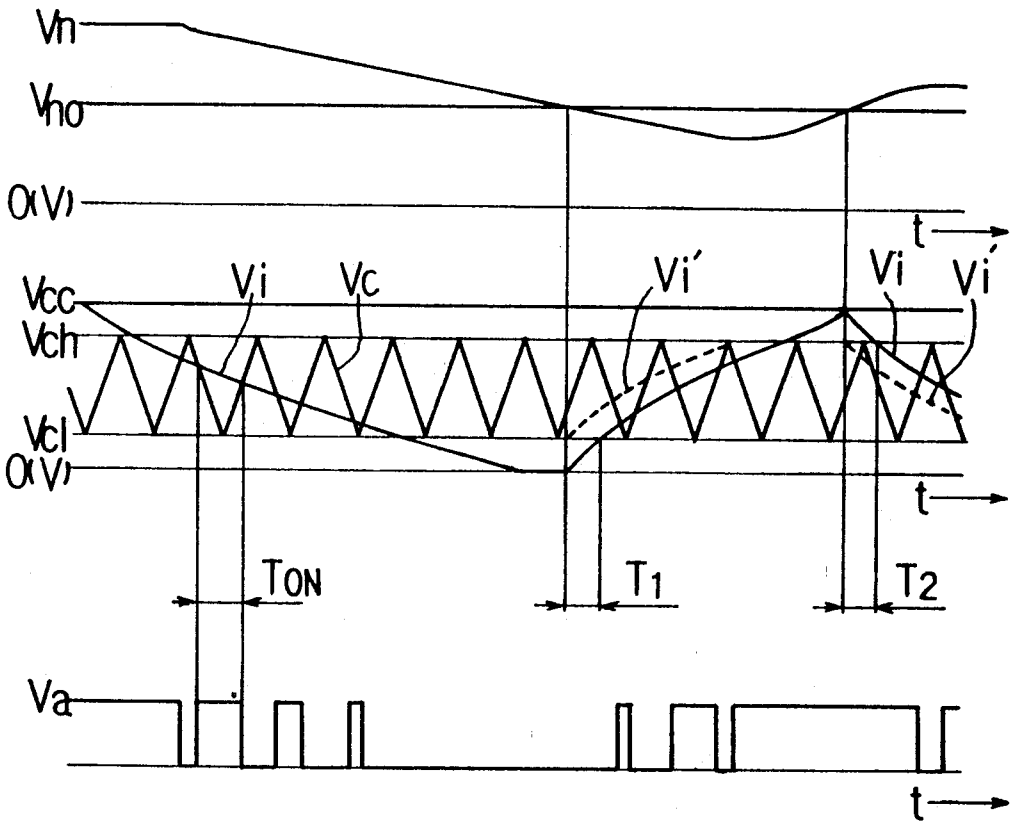
FIGS. 2A to 2C each are a waveform chart showing a waveform of eac of parts of the rotational speed control system shown in FIG. 1.

A signal waveform indicated at a solid line in each of FIGS. 2A to 2C is obtained when the operational circuit 7 and oscillator 10 are driven by a single power supply which has only one of positive and negative sides with respect to an earth level, in the case that the first and second voltage clamping circuits 13 and 14 are provided in the control system of the illustrated embodiment. In FIGS. 2A to 2C, an axis of abscissae indicates time and an axis of ordinates indicates a voltage. FIG. 2A shows a relationship between the rotational speed detection signal Vn input to the operational circuit 7 and the target rotational speed setting signal Vno, wherein the target rotational speed setting signal Vno comprises a DC voltage of a constant level. FIG. 2B shows a waveform of each of the integral voltage Vi and sawtooth signal voltage Vc, wherein the sawtooth signal voltage Vc is varied between the minimum level Vcl above an earth level and the maximum level Vch below the power supply voltage.

Supposing that the resistors R2 to R4 have resistance values R2 to R4, respectively, the maximum value Vch of amplitude of the sawtooth signal voltage Vc is represented by the following equation (1):

$$Vch = Vcc\{R3/(R2+R3)\} \quad (1)$$

When a votage drop across the diode D1 is neglected, the minimum value Vcl of amplitude of the sawtooth signal voltage Vc is represented by the following equation (2):

$$Vcl = (A/B)Vcc \quad (2)$$

wherein $$A = (R3R4)/(R3+R4) \quad (3)$$

and $$B = R2 + (R3R4)/(R3+R4) \quad (4)$$

In general, an input signal of the operational amplifier OP1 is set within a drive voltage of an operational element, therefore, an oscillating condition is $0 < Vcl < Vch < Vcc$. Thus, the sawtooth signal voltage Vc has a waveform oscillating between Vcl and Vch.

The integral voltage Vi falls at a predetermined inclination when $Vn > Vno$ and approaches zero (0) when $Vn > Vno$ is continued for a significant period of time; whereas it rises at a predetermined inclination when $Vn < Vno$ and approaches the power supply voltage Vcc when $Vn < Vno$ is continued for a significant period of time. Thus, the integral voltage Vi is varied between the power supply voltage Vcc and the earth voltage of 0 volt.

FIG. 2C shows a waveform of the pulse signal Va obtained from the comparator CP1 constituting the pulse width modulation circuit; wherein when the rotational speed detection signal Vn is below and above the target rotational speed setting signal Vno, a pulse width of the pulse signal Va is increased and reduced, respectively. However, in the case that the first and second voltage clamping circuits 13 and 14 are not provided, the output of the comparator CP1 is not varied when the integral voltage Vi is between the maximum value Vch of the sawtooth signal voltage Vc and the power supply voltage Vcc and between the minimum value Vcl of the sawtooth signal voltage Vc and 0 V. Thus, a dead time or dead section occurs in controlling of the rotational speed to cause a response to the controlling to be delayed, leading to a disadvantage that overshoot of the controlling is increased.

Arrangement of the first and second voltage clamping circuits 13 and 14, as indicated at dotted lines in FIG. 2B, permits the integral voltage Vi' to be varied within amplitude of the sawtooth signal voltage Vc, to thereby prevent occurrence of the overshoot. When the integral voltage Vi which is not limited as indicated at a solid line in FIG. 2B is compared with the integral voltage Vi' limited, the integral voltage Vi' falls into a range of a level compared with the sawtooth signal voltage Vc in advance of the integral voltage Vi by time of T1 or T2. Thus, the integral voltage Vi' permits a response to the controlling to be accelerated as compared with the integral voltage Vi.

As can be seen from the foregoing, when arrangement of the first and second voltage clamping circuits 13 and 14 causes a variation of the integral voltage to be limited within the range of amplitude of the sawtooth signal voltage, occurrence of a dead time or dead section in the controlling is prevented. This results in a response to the controlling being accelerated and the overshoot being reduced.

While a preferred embodiment of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A rotational speed control system for an internal combustion engine, comprising:

a fuel feed rate adjusting means for adjusting a rate of fuel fed to the internal combustion engine;

an actuator for actuating said fuel feed rate adjusting means;

a rotational speed detecting circuit for detecting a rotational speed of the internal combustion engine to generate a speed detection signal;

a target speed setting circuit for generating a target speed setting signal representing a target rotational speed of the internal combustion engine;

a comparator for carrying out comparison between said speed dection signal and said target speed setting signal, to thereby generate an integration command signal while said speed detection signal does not exceed said target speed setting signal;

an integrating circuit including an integrating capacitor and permitting said integrating capacitor to be charged at a predetermined time constant while said comparator generates said integration command signal;

an oscillator for generating a sawtooth signal voltage varied between a minimum level above an earth level and a maximum level lower than a power supply voltage;

a pulse width modulation circuit for carrying out comparison between an integral voltage obtained across said integrating capacitor and said sawtooth signal voltage, to thereby generate a pulse signal kept at a high level for a period of time during which said integral voltage exceeds said sawtooth signal voltage;

an actuator driving circuit fed with said pulse signal generated from said pulse width modulation circuit and permitting a drive current to flow through said actuator for a period of time during which said pulse signal is kept at a high level; and a voltage limiting circuit for limiting a maximum level of said integral voltage to said maximum level of said sawtooth signal voltage or below and a minimum level of said integral voltage to a minimum level of said sawtooth signal voltage or above.

2. A rotational speed control system as defined in claim 1, wherein said voltage limiting circuit comprises:

a first voltage clamping circuit for limiting said maximum level of said integral voltage to said maximum level of said sawtooth signal voltage or below; and a second voltage clamping circuit for limiting said minimum level of said integral voltage to said minimum level of said sawtooth signal voltage or above.

3. A rotational speed control system as defined in claim 2, wherein said first and second clamping circuits each comprise:

a reference voltage generating circuit for generating a reference voltage;

a diode connected to one end of said integrating capacitor; and an operational amplifier having an outpur terminal connected to said diode, a negative input terminal connected to said one end of said integrating capacitor and a positive input terminal fed with said reference voltage.

4. A rotational speed control system for an internal combustion engine, comprising:

a fuel feed rate adjusting means for adjusting a rate of fuel fed to the internal combustion engine;

an actuator for actuating said fuel feed rate adjusting means;

a rotational speed detecting circuit for detecting a rotational speed of the internal combustion engine to generate a speed detection signal;

a target speed setting circuit for generating a target speed setting signal representing a target speed of the internal combustion engine;

a comparator for carrying out comparison between said speed dection signal and said target speed setting signal, to thereby generate an integration command signal while said speed detection signal does not exceed said target speed setting signal;

an integrating circuit including an integrating capacitor and permitting said integrating capacitor to be charged at a predetermined time constant while said comparator generates said integration command signal;

an oscillator for generating a sawtooth signal voltage;

a pulse width modulation circuit for generating a pulse signal depending on a difference between an integral voltage obtained across said integrating capacitor and said sawtooth signal voltage;

an actuator driving circuit fed with said pulse signal generated from said pulse width modulation circuit, to thereby permit a drive current to flow through said actuator; and a voltage limiting circuit for limiting a maximum level of said integral voltage to said maximum level of said sawtooth signal voltage or below and a minimum level of said integral voltage voltage to a minimum level of said sawtooth signal voltage or above.

5. A rotational speed control system as defined in claim 4, wherein said voltage limiting circuit comprises:

a first voltage clamping circuit for limiting said maximum level of said integral voltage to said maximum level of said sawtooth signal voltage or below; and a second voltage clamping circuit for limiting said minimum level of said integral voltage to said minimum level of said sawtooth signal voltage or above.

6. A rotational speed control system as defined in claim 4, wherein said sawtooth signal voltage generated from said oscillator is varied between a minimum level above an earth level and a maximum level lower than a power supply voltage.

* * * * *